US006708840B2

(12) United States Patent
Grinberg

(10) Patent No.: US 6,708,840 B2
(45) Date of Patent: Mar. 23, 2004

(54) DISPOSABLE GLOVE FOR A GLOVE DONNING SYSTEM

(75) Inventor: Daniel Grinberg, New York, NY (US)

(73) Assignee: Foodhandler, Inc., Westbury, NY (US)

( * ) Notice: Subject to any disclaimer, the term of this patent is extended or adjusted under 35 U.S.C. 154(b) by 0 days.

(21) Appl. No.: 10/328,645

(22) Filed: Dec. 23, 2002

(65) Prior Publication Data

US 2003/0136792 A1 Jul. 24, 2003

Related U.S. Application Data

(63) Continuation of application No. 09/865,788, filed on May 25, 2001, now Pat. No. 6,497,340, which is a continuation-in-part of application No. 09/478,654, filed on Jan. 6, 2000, now abandoned.

(51) Int. Cl.[7] ..... B65H 1/00; A41D 19/00; A63B 71/14

(52) U.S. Cl. ..... 221/34; 2/159; 2/161.6

(58) Field of Search ..... 221/34, 45, 26; 2/158, 159, 161.6; 211/49.1, 59.2

(56) References Cited

U.S. PATENT DOCUMENTS 4,519,504 A 5/1985 Nausedas
4,595,389 A 6/1986 LehmacherL
4,773,532 A * 9/1988 Stephenson ..... 206/278
4,844,293 A 7/1989 McLaughlin
4,863,084 A * 9/1989 Nabozny ..... 2/161.6
4,928,322 A 5/1990 Bradfield
5,119,968 A 6/1992 Palmer
5,655,682 A * 8/1997 Hoffrichter ..... 221/45
5,806,099 A * 9/1998 Grinberg ..... 2/158
5,921,434 A * 7/1999 Hollander et al. ..... 221/34
5,966,741 A * 10/1999 Klecina ..... 2/159
2001/0037516 A1 11/2001 Grinberg
2002/0060221 A1 5/2002 Grinberg

* cited by examiner

*Primary Examiner*—Gene O. Crawford
(74) *Attorney, Agent, or Firm*—Christie, Parker & Hale, LLP

(57) ABSTRACT

A disposable glove for a glove donning system is provided. The disposable glove has a first layer and a second layer. The second layer superimposes a region of the first layer. The first and second layers are joined together along their peripheries to form a abutted portion and an opening for inserting a hand between the first and second layers. The first layer of the glove has a mounting section having a mounting hole and a line of weakness extending between the mounting hole and a rear edge of the mounting section; said mounting hole for mounting the glove on fastening means of a glove rack. The glove is mounted on the glove rack by inserting the fastening means into the mounting hole of the glove, and the glove on the glove rack can be taken off the glove rack by inserting a hand into the glove and applying a force to the glove in a direction of donning.

17 Claims, 5 Drawing Sheets

DISPOSABLE GLOVE FOR A GLOVE DONNING SYSTEM

CROSS-REFERENCE TO RELATED APPLICATIONS

This application is a continuation of U.S. patent application Ser. No. 09/865,788 entitled "Disposable Glove Donning System" filed May 25, 2001, now U.S. Pat. No. 6,497,340 on Dec. 24, 2002, the contents of which are fully incorporated by reference herein, which is a continuation-in-part of U.S. patent application Ser. No. 09/478,654 filed Jan. 6, 2000, now abandoned. This application contains subject matter related to the subject matter disclosed in U.S. patent application Ser. No. 09/934,110 entitled "Glove Cartridge and Method of Donning a Disposable Glove" filed Aug. 21, 2001.

FIELD OF THE INVENTION

The present invention relates to disposable gloves for a glove system, and particularly to easily donned disposable gloves that can be mounted on and donned off a glove rack.

BACKGROUND OF THE INVENTION

Disposable gloves are mandatory equipment in many industries that require clean and/or sterile environments, e.g., the foodservice industry. The use of disposable gloves reduces the spread of viruses and other contaminants among individuals. In the foodservice industry, such contaminants are less likely to be transmitted from employees to food when employees regularly wear gloves, when employees frequently and regularly replace used gloves with new ones, and when gloves require little handling to be donned.

Many types of disposable gloves are known to and used by the foodservice industry. One type comprises two superimposed layers of thermoplastic film sealed together along their peripheries, leaving an opening for a hand to be inserted between the two layers. A two-layered disposable mitt is shown in Grinberg U.S. Pat. No. 5,806,099, and a method of forming such a mitt is shown in Bradfield U.S. Pat. No. 4,928,322. (It is intended that the word 'glove' include both multi-finger mitts and five-finger gloves.)

Disposable gloves are generally sold in stacked units containing a supply of gloves layered one on top of the other. Gloves may be sold in a dispenser, such as a paperboard box, which encloses the stack and from which gloves may be removed one at a time. (A glove is typically removed in the manner that a paper tissue is removed from a tissue dispenser.) A box dispenser thus provides a simple and economical means for protecting the stored gloves from contamination and for dispensing the gloves. Variations of box dispensers for disposable gloves are shown in McLaughlin U.S. Pat. No. 4,844,293 and Hoffrichter U.S. Pat. No. 5,655,682.

Box dispensers also have several drawbacks. For example, a disposable glove is often difficult to don after removing it from a box dispenser. Upon being dispensed, the glove may have creases and/or be folded, requiring a user to straighten it out before donning it. A user may have difficulty first finding and then separating the glove opening into which the hand is inserted. Therefore additional dispensing configurations have also been developed. One such configuration comprises a stack (or 'saddle') of disposable gloves held together by a heat-fused detachable portion of the gloves, which portion may be covered by a flap as shown in Klecena U.S. Pat. No. 5,966,741. The gloves advantageously remain flat as they are removed from the detachable portion, in order to facilitate the process of donning them after they are removed. However, as is the case with the box dispensers, a glove must first be removed from the stack before it is donned.

It is an object of the present invention to provide an improved configuration for a disposable glove system whereby a disposable glove may be donned more easily and quickly than heretofore. The new and improved system of the present invention is especially valuable in the foodservice industry, where efficiencies in the nature of time-saving and in the ease and simplicity of donning the gloves result in significantly increased productivity and enhanced hygiene. It is a further object of the invention to provide a disposable glove rack from which a glove can be removed and donned more easily, more quickly, and more safely, in order to encourage the frequent and regular replacement of used gloves with new ones.

SUMMARY OF THE INVENTION

In an exemplary embodiment according to the present invention, a disposable glove for a glove donning system is provided. The disposable glove comprises a first layer; and a second layer superimposing a region of the first layer, said first and second layers being joined together along their peripheries to form an abutted portion and an opening for inserting a hand between the first and second layers, wherein the first layer of the glove has a mounting section having a mounting hole and a line of weakness extending between the mounting hole and a rear edge of the mounting section; said mounting hole for mounting the glove on fastening means of a glove rack, wherein the glove is mounted on the glove rack by inserting the fastening means into the mounting hole of the glove, and wherein the glove on the glove rack can be taken off the glove rack by inserting a hand into the glove and applying a force to the glove in a direction of donning.

In another exemplary embodiment according to the present invention, a disposable glove for a glove donning system is provided. The disposable glove comprises a first layer; and a second layer overlayig a region of the first layer, said first and second layers being joined together along their peripheries to form a abutted portion and an opening for inserting a hand between the first and second layers, wherein the first layer of the glove has a mounting section attached to the rest of the first layer by a transverse line of weakness, the mounting section having a mounting hole for mounting the glove on fastening means of a glove rack, wherein the glove is mounted on the glove rack by inserting the fastening means into the mounting hole of the glove, wherein the mounting section can be separated from the rest of the glove at the transverse line of weakness by inserting a hand of a user into the glove and applying a force to the glove in a direction of donning, and wherein first and second layers are fabricated from a material having little elasticity, thereby causing the opening to open with little effort by the user.

DETAILED DESCRIPTION OF THE INVENTION

Figure 2:
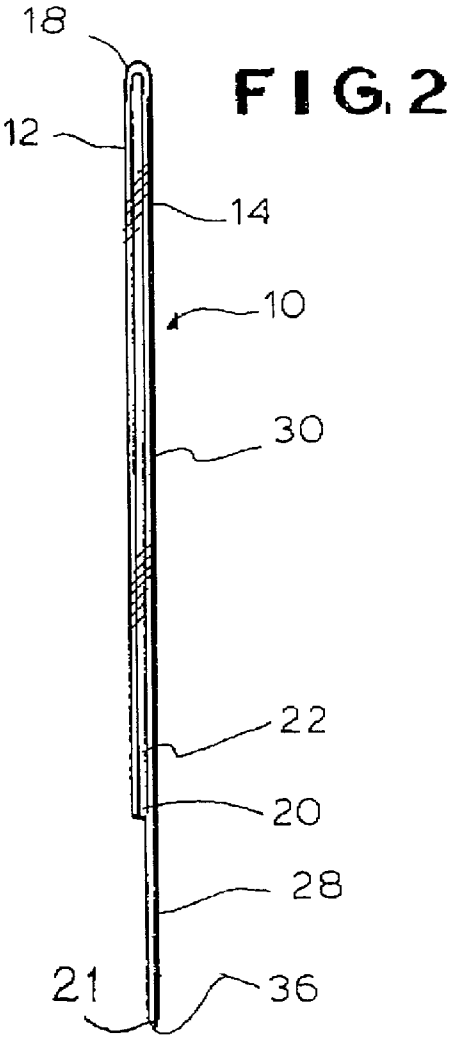
FIG. 2 is a cross-sectional view of the glove of FIG. 1, taken along line 2—2 of FIG. 1.
Figure 1:
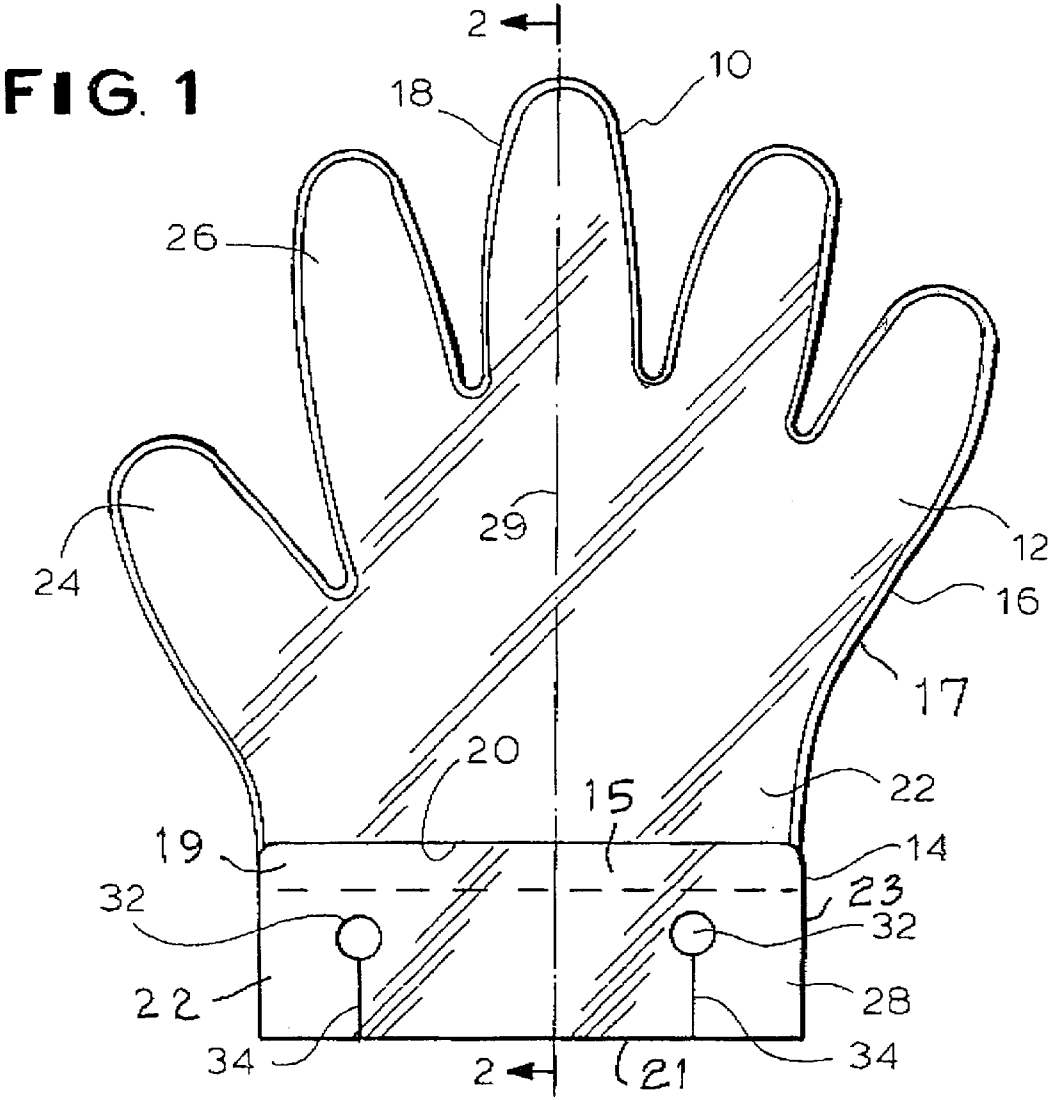
FIG. 1 is a top plan view of a glove of the present invention.

As shown in FIGS. 1 and 2, a glove 10 of the present invention has a top thermoplastic layer 12 and a bottom thermoplastic layer 14. The top layer 12 is advantageously shorter than the bottom layer 14 to provide a bare inner surface 15 of the bottom layer 14 along which a hand may be slid easily into a glove opening 20. The two layers are superimposed and are preferably fabricated from tear-resistant plastic film, such as polyethylene film. The top and bottom layers 12, 14 are joined together along their peripheries 16, 17 (respectively) to form an abutted portion 18, and the layers in the wrist region of the glove are not joined together in order to provide a glove opening 20 where the fingers of a hand are inserted between the layers 12, 14. The top and bottom layers may be joined by heat welding or a similar process.

The glove opening 20 is designed to allow the entire hand to be inserted quickly and easily between the two layers of plastic film. In particular, an extended region 19 of the bottom layer 14 is not overlayed by the top layer 12, providing the bare inner surface 15 of the bottom layer 14 for permitting the easy donning of a glove. Moreover, each plastic layer is preferably fabricated from a material having little elasticity, such as polyethylene, causing the glove opening 20 to open immediately with little effort by a user upon donning the glove. The top 12 and bottom 14 layers of the glove are preferably shaped to form a separate pocket for each finger, where each pocket is sufficiently large to permit a finger to be slid easily thereinto. Alternately, the glove may be shaped to form a mitt having a thumb region and a separate pocket for covering all other fingers.

The bottom layer 14 of the glove has a mounting section 28 attached to its extended region 19 by a transversely oriented line of weakness 33, i.e., a perforated line in the plastic film substantially perpendicular to the longitudinal axis 29 of the glove. The mounting section 28 is preferably integrally formed with the bottom layer 14. The mounting section 28 includes at least one hole 32 (or "key-hole 32") for receiving an arm or other type of fastener of a glove rack. The mounting section 28 preferably has two key-holes 32, wherein each keyhole is positioned approximately 1 inch from the rearmost edge 21 of the mounting section and approximately 1 inch from the respective side edge 22, 23 of the mounting section.

Figure 3:
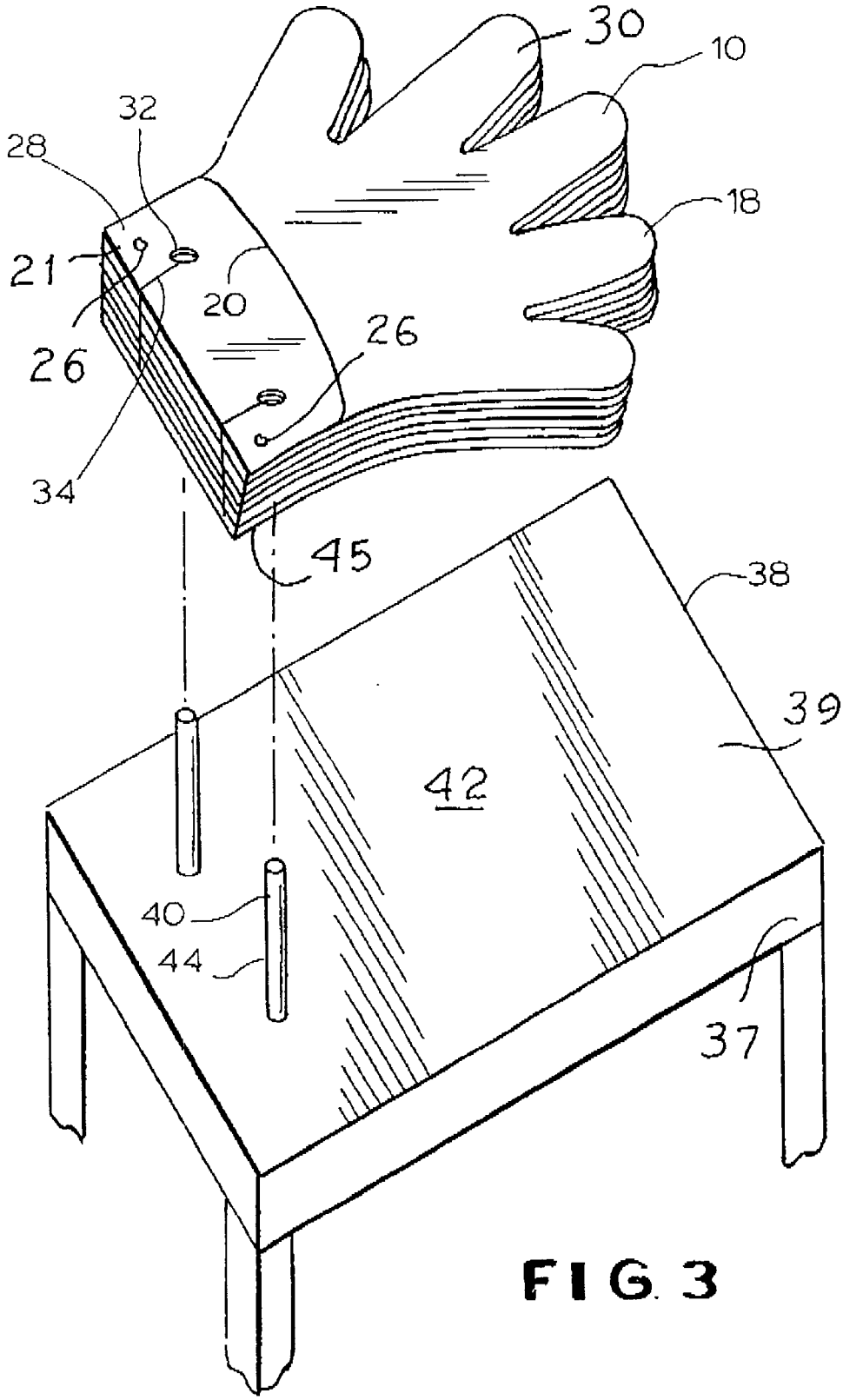
FIG. 3 is an exploded perspective view of an embodiment of a disposable glove system having a stacked unit of gloves and a first embodiment of a glove rack.

An embodiment of a disposable glove system, including a stacked unit of gloves 30 and a flat glove rack that rests on top of a substantially horizontal surface, is shown in FIG. 3. The stacked unit of gloves may comprise an integral stack of individual gloves heat welded together in one or more regions of their mounting sections 28, e.g., by hot-punches which create small holes 26 through the mounting sections 28. Alternately, the individual gloves may be fastened to each other by tie straps extending through their mounting holes, which tie straps may also be fastened to a flat section of paperboard immediately beneath the stacked unit of gloves in order to hold the gloves securely thereto. The tie straps may be removed, and the gloves separated from the paperboard, before mounting the gloves to a glove rack. Any number of gloves, between roughly ten and two-hundred, may be included in a stacked unit. A stacked unit generally has a narrow region 45 proximate the mounting sections 28 of the gloves 10 because the mounting section of each glove comprises a single layer of plastic film, in contrast to the dual layers of the hand portion.

The glove rack 37 in FIG. 3 comprises a support structure 38 with at least one fastener 40 mounted thereto (two fasteners shown). The fasteners 40 may be in the form of straight wicket posts 44, or arms, affixed to a flat surface 39 of the support structure 38, which surface also provides the mounting surface 42 for the gloves. It is intended that other types of fasteners can also be used. The gloves 10 are mounted to the glove rack 37 by directing the fasteners 40 through the key-holes 32 of the mounting section 28 of the stacked unit of gloves 30 and then laying the gloves on top of the mounting surface 42 of the rack.

The mounting section of a glove may have longitudinal lines of weakness 34 extending from each mounting hole 32 to the rearmost edge 21 of the mounting section 28. Such lines of weakness, substantially parallel to the longitudinal axis of the glove 10, provide an alternate means for removing a glove from the glove rack. Longitudinal lines of weakness 34 replace the single transverse line of weakness (reference numeral 33 in FIG. 1), thus eliminating any residual mounting portion that might otherwise remain on the glove rack after a glove is removed.

Figure 4:
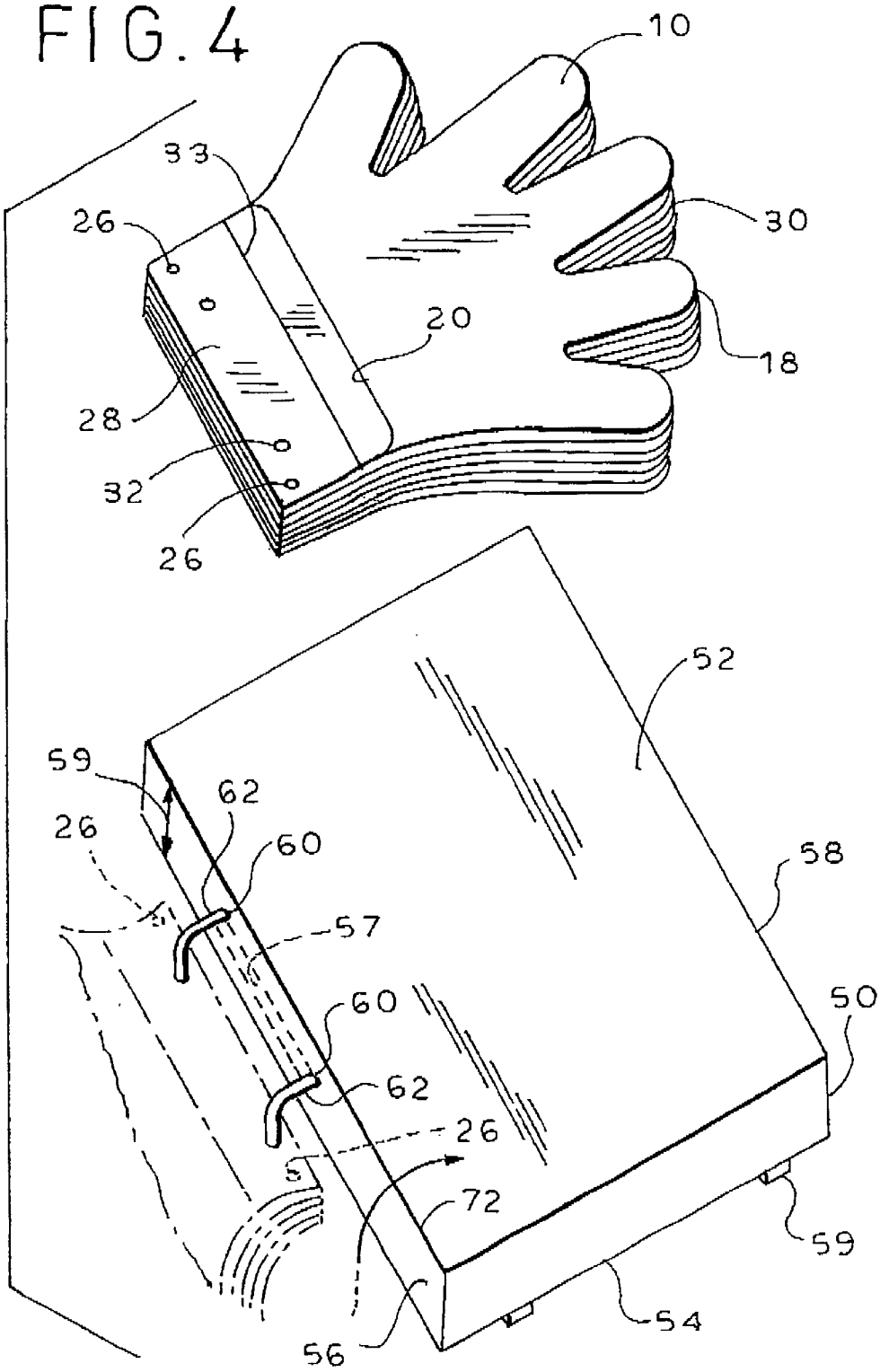
FIG. 4 is an exploded perspective view of a preferred embodiment of the disposable glove system of the present invention having a stacked unit of gloves and a second embodiment of a glove rack.
Figure 5:
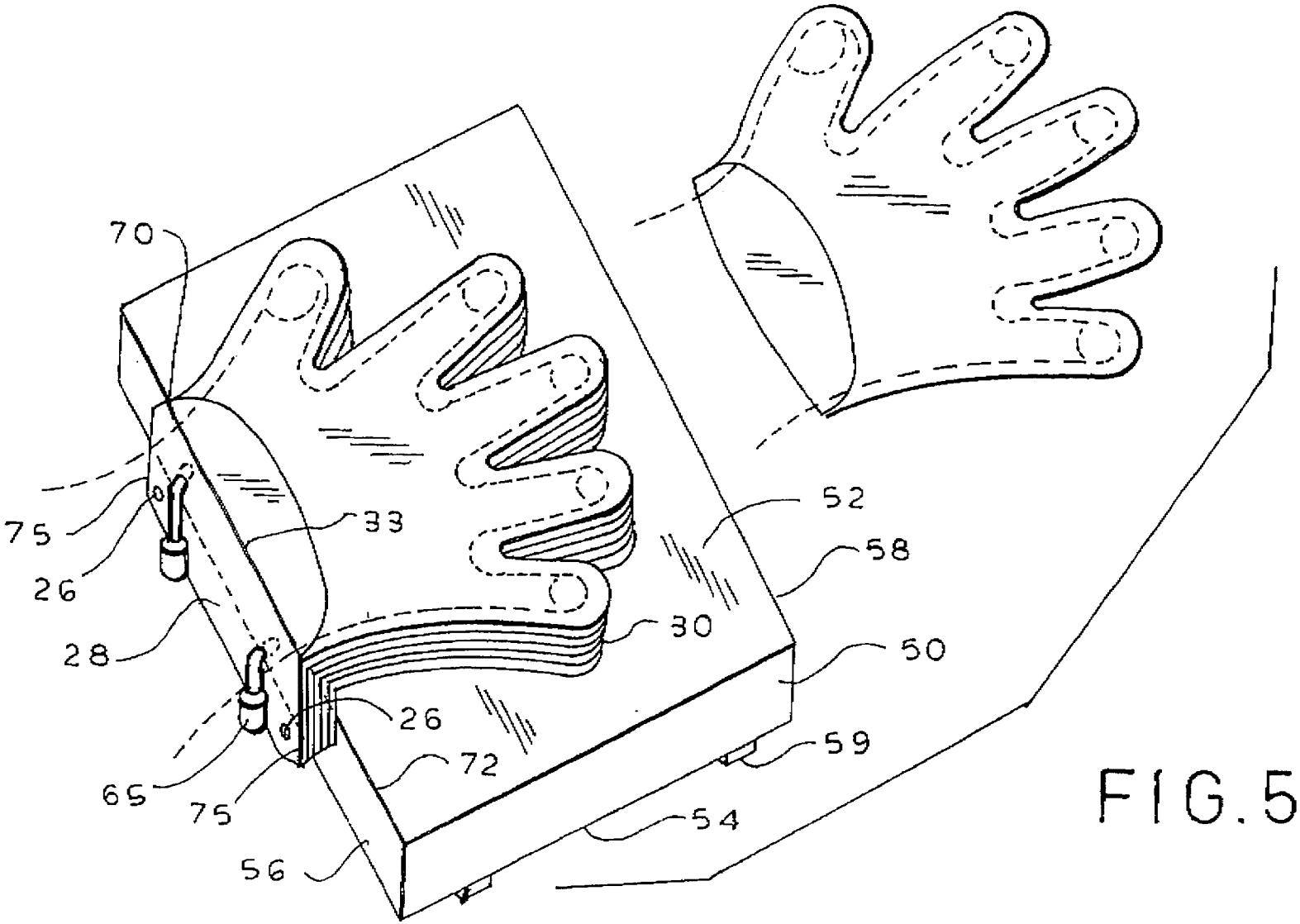
FIG. 5 is a perspective view of the embodiment of FIG. 4, showing the path of a glove being donned and removed from the glove rack.

As shown in FIGS. 4 and 5, the preferred dispensing system of the present invention includes a stacked unit of gloves 30 mounted on a glove rack 50 specially configured for dispensing the gloves quickly, safely, and easily. The glove rack has a top mounting surface 52, a bottom surface 54, a front surface 56, and a rear surface 58. The front surface 56 has two fasteners 60 protruding therefrom. The fasteners 60 preferably comprise J-shaped arms 62 which point toward the bottom surface 54 of the glove rack. The two fasteners shown may be joined to each other by an intermediate member 57 (shown in phantom) to provide a single C-shaped structure that may be easily mounted to the front surface 56, e.g., by an adhesive. The gloves 10 are mounted to the glove rack 50 by directing the fasteners 60 through the mounting holes 32 of the mounting sections 28 of the gloves 10. The gloves are then draped over the top surface 54 of the glove rack.

As an important aspect of the preferred embodiment of a glove rack of the present invention, the J-shaped fasteners 62 are positioned on the front surface 56 of the glove rack 50, instead of on the glove mounting surface 52, to allow the safe and easy donning of a glove. To don a glove, a user inserts a hand into the opening 20 of the top glove—advantageously while the glove is attached to the glove rack—and urges the glove forward toward the abutted (finger) portion 18 of the glove. Fasteners mounted on the top mounting surface of a glove rack may otherwise interfere with and/or injure the hand or the wrist while donning a glove. In contrast, the front-mounted fasteners 62 point forward and downward in order to avoid the hand or wrist entirely as the top glove is donned. Therefore, in the preferred glove rack, there are no encumbrances that interfere with the hand or wrist of a user, as there are in the embodiment of FIG. 3. Once a hand is safely inside the glove, the sliding motion by the hand causes the transverse line of weakness 33 to separate, releasing the glove from the glove rack.

Figure 6:
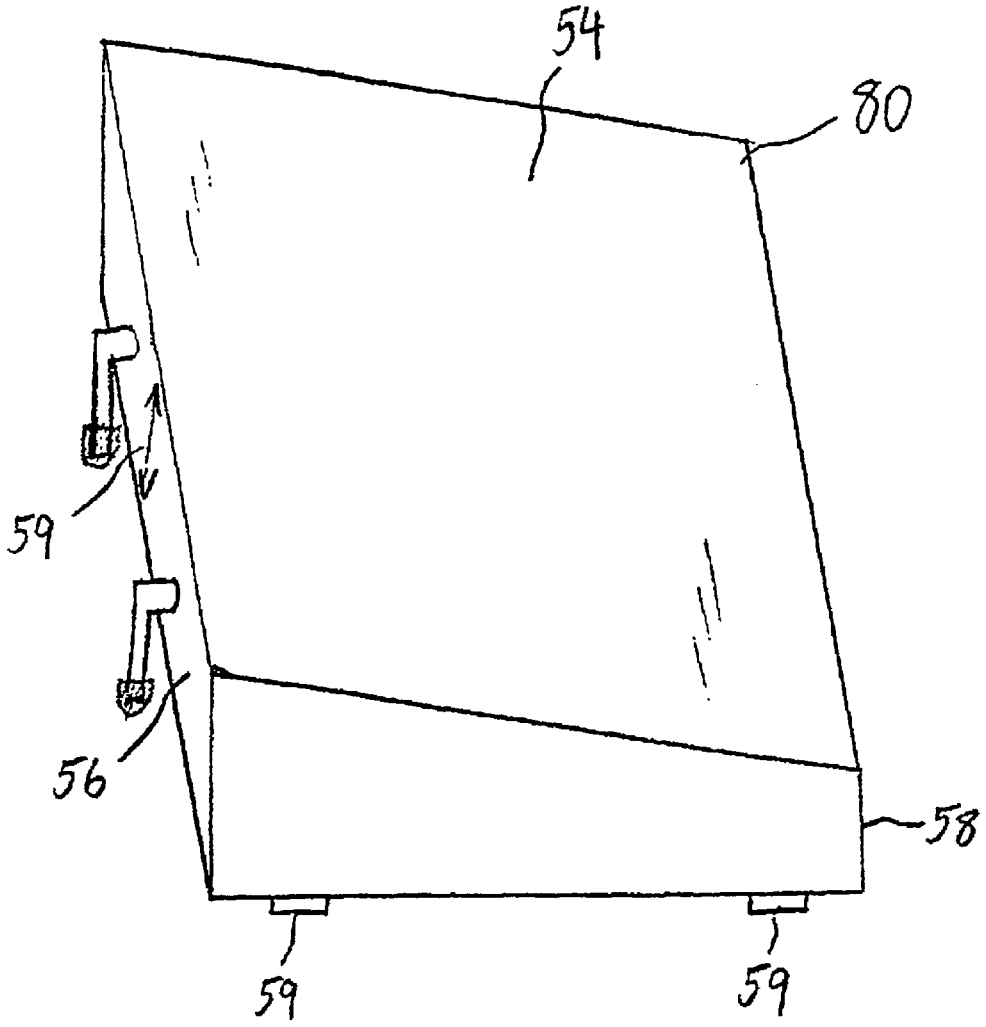
FIG. 6 is a perspective view of an alternate preferred embodiment of the glove rack of the present invention.

As shown in FIG. 6, an alternate preferred embodiment 80 of the glove rack has additional advantageous features. The top surface 54 is between 1 and 3 inches above the bottom surface, and the width 59 of the front surface 56 is preferably greater than that of the rear surface 58. Thus the top mounting surface is angularly displaced from the front surface of the rack by an obtuse angle, providing a more ergonomic design whereby the path of donning the glove points downward to permit a hand to slide more easily into the glove. Because the top surface is elevated, one's fingers do not hit the surface on top which the glove rack rests as a glove is donned. The glove rack is preferably composed of a material that is portable yet sufficiently heavy to prevent the rack from moving as a glove is donned and removed, such as a metal or a rigid plastic. The glove rack may also have rubber feet (not shown) mounted on its bottom surface in order to grip a surface more securely, and may have permanent securing means for securing the glove rack permanently to a horizontal or vertical surface. Plastic and/or rubber covers 65 may be attached to the fasteners for further reducing any possibility that a user might be injured by the glove rack. The glove rack advantageously has no side walls to permit simple and economical construction thereof.

The stacked unit of gloves also has several advantageous features. As shown in FIG. 5, the bend 70 in the gloves is preferably positioned above the edge 72 where the top mounting surface 52 and the front surface 56 of the glove rack intersect, causing the gloves to separate more easily from the rack because their tear lines (lines of weakness) are creased above the edge 72. The bend 70 also causes the glove opening of the top glove to spread apart slightly, thus increasing the ease of donning the gloves and eliminating the need to handle the gloves when donning them. The angular displacement between the front and top surfaces of the rack also relieves the region 75 of plastic film immediately surrounding the key-holes of each glove of magnified stress as the glove is removed, thus causing the glove to tear along its tear line and preventing the region 75 proximate the keyholes from otherwise ripping. The stacked unit of gloves may be sold either together with the glove rack or separately as a replacement saddle of gloves.

Although the glove in FIG. 5 may be worn on either the right or left hand, it is more easily donned by the right hand. (The glove may also be donned by the left hand by rotating turning one's left hand palm-up while donning the glove.) A stacked unit of left-handed gloves that are the mirror image of the glove of FIG. 5, but otherwise identical, may also be manufactured to allow a user to don gloves onto both hands in the more ergonomic palm-down manner.

It will be appreciated that, when longitudinal lines of weakness are used instead of a single transverse line of weakness, the entire glove 10 is released from the glove rack and no portion of the gloves 10 remains behind. Also, it will be appreciated that the strength of the material forming the mounting section 28 and the reduction in such strength caused by the lines of weakness 34 can be adjusted to create an optimal design.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A disposable glove for a glove donning system, comprising:

a first layer;

a second layer superimposing a region of the first layer, said first and second layers being joined together along their peripheries to form an abutted portion and an opening for inserting a hand between the first and second layers, wherein the first layer of the glove has a mounting section having a mounting hole and a line of weakness extending between the mounting hole and a rear edge of the mounting section; said mounting hole for mounting the glove on a glove rack having a top surface and a front surface that are positioned at an angle with respect to one another and having fastening means for mounting the glove protruding from the front surface, wherein the glove is mounted on the glove rack by inserting the fastening means into the mounting hole of the glove and bending the glove such that a portion of the glove is placed on the top surface while a remaining portion including the mounting section is placed adjacent to the front surface, wherein the first layer of the glove has an extended region not overlaid by the second layer, wherein the extended region is positioned between the opening and the mounting section of the glove, and wherein when the glove is bent on the glove rack, at least a portion of the extended region adjacent to the opening is exposed on the top surface of the glove rack such that the glove can be taken off the glove rack by inserting a hand into the glove through sliding the hand over the exposed extended region on the top surface into the opening and applying a force to the glove in a direction of donning.

2. The disposable glove of claim 1, wherein the glove is fabricated from a thermoplastic film having little elasticity.

3. The disposable glove of claim 1, wherein the glove is fabricated from a tear-resistant plastic film.

4. The disposable glove of claim 1, wherein the mounting section has two mounting holes.

5. The disposable glove of claim 1, wherein the first and second layers form a plurality of pockets, each pocket for inserting a finger.

6. The disposable glove of claim 1, wherein the first and second layers form two pockets comprising a first pocket to insert a thumb and a second pocket to insert all other fingers.

7. The disposable glove of claim 1, wherein the glove is stackable in a stack with a plurality of other gloves, wherein said glove is donned when it is at a top of the stack.

8. The disposable glove of claim 7, wherein the glove is fastened together with said other gloves in the stack through heat welding or using a tie strap.

9. A disposable glove for a glove donning system comprising:

a first layer;

a second layer overlaying a region of the first layer, said first and second layers being joined together along their peripheries to form an abutted portion and an opening for inserting a hand between the first and second layers, wherein the first layer of the glove has a mounting section attached to the rest of the first layer by a transverse line of weakness, the mounting section having a mounting hole for mounting the glove on a glove rack having a top surface and a front surface that are positioned at an angle with respect to one another and having fastening means for mounting the glove protruding from the front surface, wherein the glove can be mounted on the glove rack by inserting the fastening means into the mounting hole of the glove and bending the glove such that a portion of the glove is placed on the top surface while a remaining portion including the mounting section is placed adjacent to the front surface, wherein the first layer of the glove has an extended region proximate the opening and not overlaid by the second layer, wherein the mounting section of the glove is attached to the extended region of the first layer of the glove by the transverse line of weakness, and wherein when the glove is bent on the glove rack, at least a portion of the extended region adjacent to the opening is exposed on the top surface of the glove rack such that the mounting section on the glove rack can be separated from the rest of the glove at the transverse line of weakness by inserting a hand of a user into the glove through sliding the hand over the exposed extended region on the top surface into the opening and applying a force to the glove in a direction of donning.

10. The disposable glove of claim 9, wherein the glove is fabricated from a thermoplastic film.

11. The disposable glove of claim 9, wherein the glove is fabricated from a tear-resistant plastic film.

12. The disposable glove of claim 9, wherein the mounting section has two mounting holes.

13. The disposable glove of claim 9, wherein the transverse line of weakness comprises a perforated line.

14. The disposable glove of claim 9, wherein the first and second layers form a plurality of pockets, each pocket for inserting a finger.

15. The disposable glove of claim 9, wherein the first and second layers form two pockets comprising a first pocket to insert a thumb and a second pocket to insert all other fingers.

16. The disposable glove of claim 9, wherein the glove is stackable in a stack with a plurality of other gloves, wherein said glove is donned when it is at a top of the stack.

17. The disposable glove of claim 16, wherein the glove is fastened together with said other gloves in the stack through heat welding or using a tie strap.

* * * * *